United States Patent [19]

Dearth

[11] 4,396,064

[45] Aug. 2, 1983

[54] METHOD AND APPARATUS FOR INJECTING A GASEOUS STREAM INTO A SUBTERRANEAN ZONE

[75] Inventor: James D. Dearth, Dallas, Tex.

[73] Assignee: Atlantic Richfield Company, Los Angeles, Calif.

[21] Appl. No.: 263,624

[22] Filed: May 14, 1981

[51] Int. Cl.[3] ..... E21B 33/14; E21B 36/00; E21B 43/243

[52] U.S. Cl. ..... 166/285; 166/57; 166/242; 166/256; 166/261; 166/302

[58] Field of Search ..... 166/57, 59, 242, 256, 166/261, 268, 272, 302, 303, DIG. 1, 285; 60/641.2, 641.3

[56] References Cited

U.S. PATENT DOCUMENTS

| | | | |
|---|---|---|---|
| 1,804,078 | 5/1931 | Baden | 166/242 X |
| 2,148,717 | 2/1939 | Whitney | 166/272 |
| 3,130,264 | 2/1964 | Barron | 166/303 X |
| 3,142,336 | 7/1964 | Doscher | 166/57 X |
| 3,221,813 | 12/1965 | Closmann et al. | 166/272 X |
| 3,358,756 | 12/1967 | Vogel | 166/272 X |
| 3,372,754 | 3/1968 | McDonald | 166/59 |
| 3,760,876 | 9/1973 | Blount et al. | 166/57 |
| 3,820,605 | 6/1974 | Barber et al. | 166/57 X |
| 3,878,312 | 4/1975 | Bergh et al. | 166/242 X |
| 4,147,213 | 4/1979 | Hollingsworth | 166/242 X |

FOREIGN PATENT DOCUMENTS

| | | | |
|---|---|---|---|
| 783427 | 4/1968 | Canada | 166/272 |

*Primary Examiner*—James A. Leppink
*Assistant Examiner*—George A. Suchfield
*Attorney, Agent, or Firm*—F. Lindsey Scott

[57] ABSTRACT

In a method for injecting a gaseous stream into a hot subterranean zone by positioning a casing means in fluid communication with the hot subterranean zone and the surface; insulating a lower portion of the outer surface of the casing, the insulated lower portion including the portion of the casing in the hot subterranean zone; and injecting the gaseous stream into the hot subterranean zone through the casing at a rate sufficient to maintain the casing below a selected maximum temperature, the improvement comprising: the use of a reduced diameter casing as the lower portion of the casing. An apparatus useful in the practice of the improved method is disclosed.

9 Claims, 4 Drawing Figures

METHOD AND APPARATUS FOR INJECTING A GASEOUS STREAM INTO A SUBTERRANEAN ZONE

This invention relates to methods for injecting a gaseous stream into a hot subterranean zone.

This invention further relates to an apparatus for use in the injection of a gaseous stream into a hot subterranean zone.

In many processes for the recovery of heat values from carbonaceous deposits such as petroleum deposits, shale oil deposits, coal of various grades, and the like, by the partial combustion of the deposit, a continuing problem exists in the injection of oxygen containing gas into the carbonaceous deposit. More specifically, the oxygen injected to support the combustion required in such processes tends to result in extremely high temperatures in the vicinity of the injection wells at some time during their life in the practice of the process. Such problems have resulted in well failures, well subsidence, and the like. Since it is necessary in the practice of such processes that gaseous streams containing free oxygen be injected, and since the presence of high temperatures is inevitable in the vicinity of such wells, a continuing effort has been directed to the development of methods whereby gaseous streams can be economically and reliably injected into hot subterranean formations.

In the preparation of the present application, the following references were considered: U.S. Pat. No. 2,506,853, U.S. Pat. No. 3,216,499, U.S. Pat. No. 3,272,262, U.S. Pat. No. 3,338,286, and U.S. Pat. No. 3,372,754. These references are considered to be illustrative of the state of the art and are hereby incorporated in their entirety by reference.

It has now been found that gaseous streams are readily injected into hot subterranean formations by an improved method consisting essentially of:

(a) positioning a casing means in fluid communication with the hot subterranean zone and the surface;

(b) insulating a lower portion of the outer surface of the casing, the lower portion including the portion of the casing in the hot subterranean zone; and, (c) injecting the gaseous stream into the hot subterranean zone through the casing at a rate sufficient to maintain the casing below a selected maximum temperature wherein the improvement comprises the use of a reduced diameter casing as the lower portion of the casing. The method of the present invention is effectively carried out utilizing an apparatus comprising:

(a) a casing fluidly communicating the hot subterranean zone and the surface;

(b) insulation positioned on the outer surface of the lower portion of said casing, said lower portion being of a reduced diameter and including the portion of said casing in said hot zone; and, (c) an injection means adapted to inject a gaseous stream into an upper end of said casing at a flow rate through said reduced diameter casing in excess of 5 lb/sec/ft$^2$.

In the discussion of the figures, the same numbers will be used to refer to the same or similar components throughout.

Figure 1:
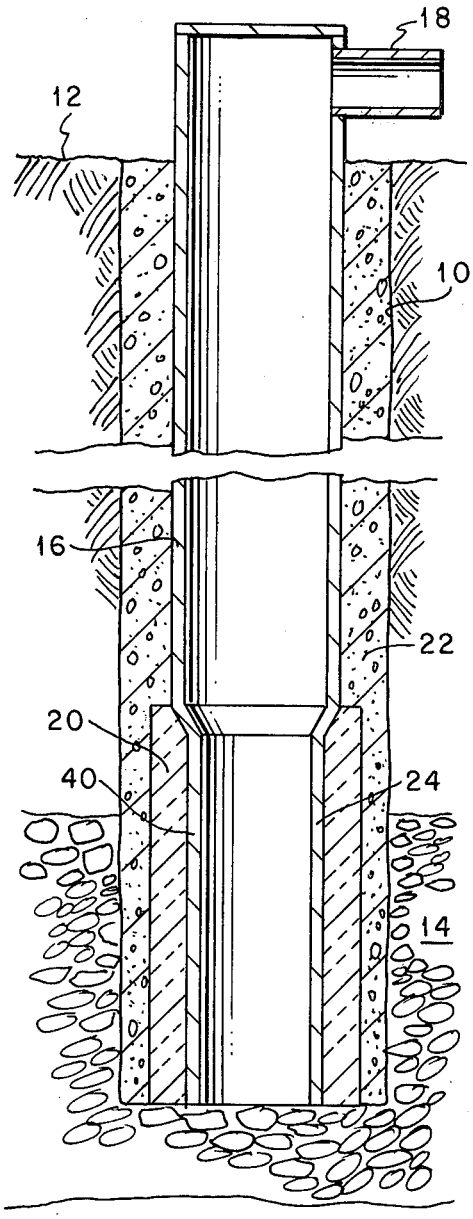
FIG. 1 is a schematic diagram of an embodiment of an apparatus useful in the practice of the present invention.

In FIG. 1, a casing 16 is shown positioned in a wellbore 10 to fluidly communicate the surface 12 and a subterranean zone 14 which may be a coal deposit, shale oil deposit, or a petroleum-bearing formation. Casing 16 is typically cemented in place in wellbore 10 with insulation 20 being positioned as shown on the outer surface of a lower portion 24 of casing 16. Lower portion 24 is of a reduced diameter as shown in FIG. 1. Typically, lower portion 24 extends to a distance above hot subterranean zone 14 sufficient to protect casing 16 from the elevated temperatures in hot zone 14. Typically, the reduced diameter casing 40 also extends above subterranean zone 14 to a zone where more moderate temperatures prevail. In the installation of casing 16, wellbore 10 is typically drilled to the desired depth and thereafter casing 10 including insulation 20 is positioned in wellbore 10 with cement 22 thereafter being used to secure casing 16 in wellbore 10 by the use of a cement shoe or other techniques known to those skilled in the art. The installation of such casings in wellbores is considered to be known to the art and will not be discussed further.

In the practice of the method of the present invention a gaseous mixture typically containing a free oxygen containing gas such as oxygen, oxygen enriched air, air, or the like, is injected through an injection means 18 and flows downwardly through casing 16 into zone 14. By comparison to the use of a casing of a constant diameter over its total length, several advantages are realized by the use of the present invention. Since wells are usually designed to accommodate a given flow rate, the improvement of the present invention achieves greater temperature reduction at a stated mass flow rate. The cooling achieved in the constant diameter casing is a function of the mass flow rate through the casing. When the same mass flow rate is used with a casing of the same diameter but including a reduced diameter casing section as its lower portion, greater cooling is realized in the lower portion since greater gas velocities are achieved in the lower portion. A slightly greater pressure drop occurs with the reduced diameter lower portion, but the added pressure drop is slight since the lower portion is normally relatively short by comparison to the total casing length.

By comparison to the use of casing of such smaller diameter over its entire length, the use of a reduced diameter lower portion with the remainder of the casing being of a larger diameter results in similar cooling in both instances at a similar mass flow rate, but when the major portion of the casing length is of the larger diameter, less pressure drop is experienced.

The positioning of the insulation is also facilitated with the use of the reduced diameter lower section of casing since the insulation is positioned about the reduced diameter section with the larger diameter casing above it. By contrast, the insulation extends outwardly from the casing in either of the other instances and is more easily damaged during installation, etc. There is also more room available for insulation in the wellbore sized for the casing when the reduced diameter lower section is used. The use of casing of the same diameter over its total length in a related method is disclosed in a copending application, Ser. No. 263,625, entitled "A Method and Apparatus for Injecting a Gaseous Stream Into a Hot Subterranean Zone" filed herewith by Herbert B. Wolcott.

Figure 2:
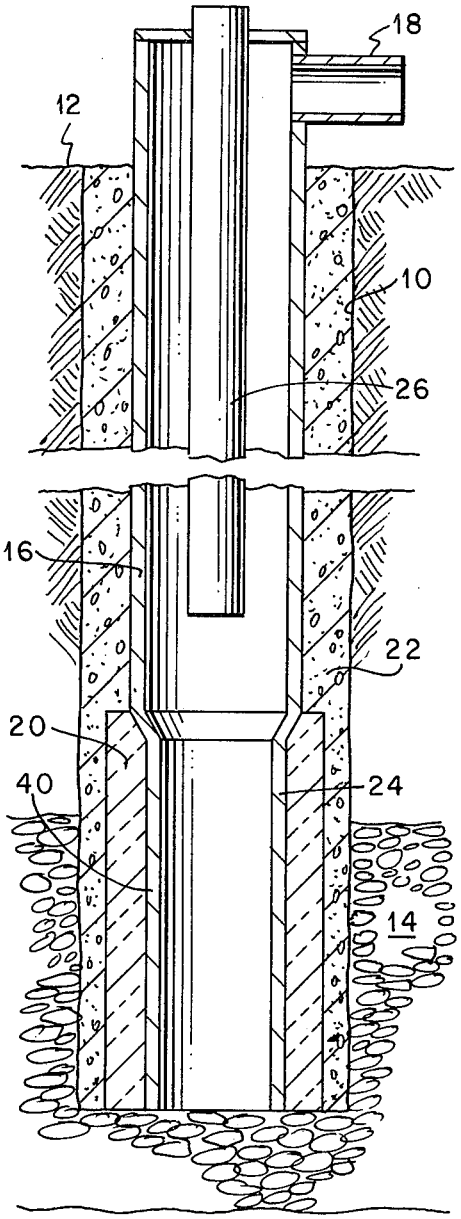
FIG. 2 is a further embodiment of the apparatus set forth in FIG. 1.

The apparatus shown in FIG. 2 includes a tubing 26 positioned in casing 16 for the injection of a free oxygen containing gas separate from other gases such as steam, carbon dioxide, or the like, which may be injected as a reactant or as a temperature control gas through injection means 18. The gases mix in casing 16 and flow through reduced diameter section 40 into zone 14.

Figure 3:
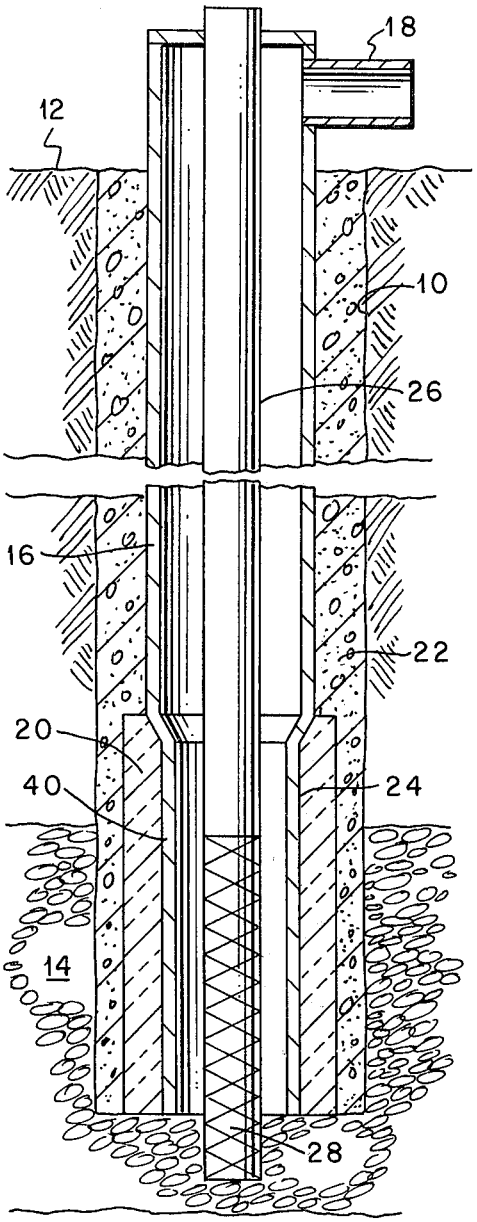
FIG. 3 is a further embodiment of the apparatus set forth in FIG. 1; and, FIG. 4 is a schematic diagram of the lower portion of the apparatus set forth in FIG. 1 showing the insulation in greater detail.

In FIG. 3, tubing 26 extends downwardly through reduced diameter section 40 and discharges into zone 14. Tubing 26 optionally includes a sprayed-on, high temperature resistant coating 28 such as zirconium oxide. Zirconium oxide is typically applied by plasma spraying and has been utilized in aircraft engines and the like at temperatures as high as about 2800° F. The melting point of zirconium oxide is about 4500° F. Such a coating tends to protect the exposed portions of tubing 26 as it extends outside casing 16. In practice, the portions of tubing 26 which extend outside casing 16 are typically burned off at substantially the bottom of casing 16.

In the practice of the method of the present invention utilizing the apparatus shown in FIG. 3, free oxygen containing gas is injected through tubing 26 into zone 14 at a flow rate which can be independent of the flow rate required in casing 16 to maintain casing 16 below a desired maximum temperature. The use of this apparatus provides considerably more flexibility than does the use of the apparatus shown in FIG. 1.

Figure 4:
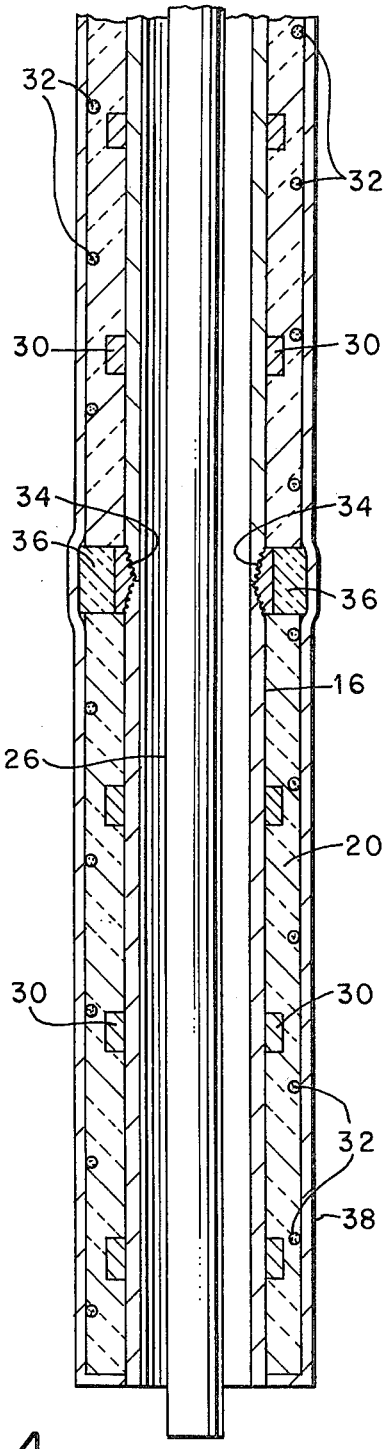

The insulation used is typically a material such as aluminum oxide, refractory fibers or the like, having a melting point in excess of about 3500° F. Such materials are routinely used in applications up to about 2600° F. and are considered to be known to those skilled in the art. Typically, in the installation of the casing as shown in FIGS. 1, 2, and 3, the insulation is positioned on casing 16 prior to installation. The insulation may be installed by a variety of methods such as the use of adhesives, by wrapping and binding the insulation to the outer circumference of the casing 16, or the like. A preferred installation method is shown in FIG. 4. Insulation 20 is positioned about the outer circumference of casing 16 and tied in place utilizing ropes 32 of the insulating material. To assist in maintaining insulation 20 in position, a plurality of projections 30 may be positioned on the outside of casing 16. The joints 34 in casing 16 are typically insulated by the use of fitted sections 36 of insulation as shown. The insulation after installation is desirably cased in a metal sheath 38 to protect it during installation in wellbore 10. The sheathing can be of any suitable material since it is exposed to the extreme temperatures in zone 14 and will be burned away quickly in hot zone 14. This sheathing is used primarily to protect the insulation during installation and it is not necessary that it remain intact after installation.

It has been found that by the method of the present invention gaseous streams can be reliably injected into such zones using casing materials normally used in the art. Typical casing materials are mild steel which has a normal operating range of up to about 900° F. It has been found that by the method of the present invention casing 16 can be kept well within its operating limits during operation in environments up to about 3500° F.

The high gas flow rates are desirable to achieve the desired cooling of casing 16. Flow rates of at least 5 lb/sec/ft$^2$ of cross-sectional area in casing 16 or in the annulus between the inner diameter of casing 16 and the outer diameter of tubing 26 are considered suitable. For greater cooling, higher flow rates are required and it is preferred that flow rates greater than about 20 lb/sec/ft$^2$ be used. Clearly, the use of higher flow rates than necessary for the injection of desired quantities of materials or for adequate cooling is not necessary. The amount of material required in the formation is dependent upon numerous variables well known to those skilled in the art. Similarly, by the use of thermocouples and the like the temperature in casing 16 can be determined and the flow rates adjusted accordingly to maintain the casing temperature below a selected maximum. In most instances, it is expected that flow rates greater than about 5 lb/sec/ft$^2$ as stated will be found suitable.

Desirably, the reduction in casing size is such that the cross-sectional area available in the reduced casing is from about 5 to about 50 percent of the cross-sectional area available in casing 16. Preferably, the reduced area is from about 10 to about 30 percent of the area in casing 16.

While the improved method and apparatus of the present invention are considered suitable for the recovery of heat values from petroleum deposits, shale oil deposits, coal deposits and the like, the method and apparatus are considered particularly suitable for use in the injection of free oxygen containing gas in the in situ gasification of underground coal deposits.

It is noted that the embodiments described above, while preferred, are illustrative rather than limiting in nature and that many variations and modifications are possible within the scope of the present invention. Many such variations and modifications may appear obvious and desirable to those skilled in the art based upon the foregoing description of preferred embodiments and the following examples.

EXAMPLE

Heat transfer and pressure drop calculations have been run for a 100-ft heated length of casing covered with 2 inches of insulation and exposed to a 3500° F. cavity temperature. The base case was a 700-ft length of 4½ inch outer diameter (J-55) casing with an inner string of 2 inch outer diameter (Schedule 40) pipe operated at the flow rates of $O_2$ and steam shown below. The results were:

| Max. Flow Case | | Min. Flow Case | |
|---|---|---|---|
| 5832 lb/hr oxygen | | 835 lb/hr oxygen | |
| 3284 lb/hr steam | | 469 lb/hr steam | |
| max casing temp | = 712° F. | max casing temp | = 1828° F. |
| max steam temp | = 604° F. | max steam temp | = 1519° F. |
| max pipe temp | = 521° F. | max pipe temp | = 1256° F. |
| max $O_2$ temp | = 484° F. | max $O_2$ temp | = 1135° F. |
| pressure drop | = 10.3 psi | pressure drop | = 1.7 psi |

Another set of cases was run in which the bottom 100 ft of 4½ inch outer diameter casing were replaced with 100 ft of 3 inch outer diameter (schedule 40) pipe. The insulation thickness was maintained at 2 inches. For this set of parameters the results were:

| Max. Flow Case | | Min. Flow Case | |
|---|---|---|---|
| 5932 lb/hr oxygen | | 835 lb/hr oxygen | |
| 3284 lb/hr steam | | 469 lb/hr steam | |
| max casing temp | = 594° F. | max casing temp | = 1537° F. |

-continued

| Max. Flow Case | | Min. Flow Case | |
|---|---|---|---|
| max steam temp | = 549° F. | max steam temp | = 1393° F. |
| max pipe temp | = 522° F. | max pipe temp | = 1302° F. |
| max $O_2$ temp | = 488° F. | max $O_2$ temp | = 1187° F. |
| pressure drop | = 31.5 psi | pressure drop | = 2.4 psi |

In the minimum flow case, where casing temperatures are most severe, use of the reduced-size casing lowered the casing temperature by nearly 300° F. The maximum increase in wellhead steam pressure required to drive flow through the restriction was less than 25 psi at the maximum steam rate. Of course, increasing the rate of convective heat transfer from the casing wall to the steam flowing in the annulus also increases the rate of convective transfer to the outside of the inner pipe; in this case the inner pipe temperature increased about 50° F. However, the inner pipe temperature is several hundred degrees lower than the casing temperature, so this small increase should not be significant.

Having thus described the invention I claim:

1. In a method for injecting a free oxygen-containing gaseous stream into a subterranean zone in processes wherein elevated temperatures occur in said subterranean zone; said method consisting essentially of:

(a) Positioning a casing means in fluid communication with said subterranean zone and the surface, the lower end of said casing being positioned near the bottom of said subterranean zone;

(b) Injecting said gaseous stream into said subterranean zone through said lower end of said casing;

an improvement comprising:

(c) Reducing the diameter of a lower portion of said casing so that the reduced diameter lower portion of said casing has a cross-sectional area from about 5 to about 50 percent of the cross-sectional area of said casing, said lower portion extending upwardly from said lower end of said casing through said subterranean zone for a distance above said subterranean zone sufficient to protect said casing from elevated temperatures in said subterranean zone;

(d) Positioning insulation selected from the group consisting of aluminum oxide and refractory fibers having a meeting point in excess of about 3500° F. about the outer circumference of said lower portion;

(e) Cementing said casing including said lower portion in place, said cement being positioned about the outer circumference of at least a portion of said insulation; and (f) injecting said gaseous stream into said subterranean zone through said casing, said lower portion and said lower end of said casing at a rate sufficient to maintain the casing temperature below about 900° F. when elevated temperatures occur in said subterranean zone.

2. The method of claim 1 wherein said gaseous stream is injected through said reduced diameter lower portion at a flow rate in excess of 5 lb./sec./ft$^2$.

3. The method of claim 1 wherein a second gaseous stream is injected into said subterranean zone through a tubing means positioned through said casing.

4. The method of claim 3 wherein said second gaseous stream comprises a free oxygen containing gas.

5. The method of claim 4 wherein said subterranean zone comprises a coal deposit.

6. An apparatus fluidly communicating the surface and a subterranean zone for injecting fluids into said subterranean zone in processes wherein elevated temperatures occur in said subterranean zone; said apparatus comprising:

(a) A casing means fluidly communicating said subterranean zone and said surface, said casing including a reduced diameter lower portion, said lower portion extending upwardly from the lower end of said casing through said subterranean zone and having a cross-sectional area from about 5 to about 50 percent of the cross-sectional area of said casing, said lower end of said casing terminating above the bottom of said subterranean zone;

(b) Insulation positioned about the outer circumference of the outer surface of said lower portion of said casing, said insulation consisting of an insulating material selected from the group consisting of aluminum oxide or refractory fibers having a melting point in excess of about 3500° F.;

(c) An injection means adapted to inject said fluid into an upper end of said casing at a flow rate sufficient to achieve the desired casing temperature control in said reduced diameter lower portion as said fluid flows through said reduced diameter portion of said casing; and (d) cement positioned about at least a portion of said casing and said insulation.

7. The apparatus of claim 6 wherein said insulation is enclosed in a sheathing means.

8. The apparatus of claim 6 wherein said apparatus includes a tubing means positioned in said casing and fluidly communicating said hot subterranean zone and said surface.

9. The apparatus of claim 8 wherein a lower portion of said tubing means extending into said subterranean zone is coated with a high temperature resistant coating.

* * * * *